US005182491A

United States Patent [19]

Taguchi et al.

[11] Patent Number: 5,182,491

[45] Date of Patent: * Jan. 26, 1993

[54] THIN FILM ELECTROLUMINESCENT DEVICE

[75] Inventors: Kazuo Taguchi, Tokyo; Kenichi Onisawa, Ibaraki; Moriaki Fuyama, Ibaraki; Katsumi Tamura, Ibaraki; Yoshio Abe, Ibaraki; Takahiro Nakayama, Ibaraki; Kenichi Hashimoto, Ibaraki; Akira Sato, Ibaraki, all of Japan

[73] Assignee: Hitachi, Ltd., Tokyo, Japan

[ * ] Notice: The portion of the term of this patent subsequent to Mar. 24, 2009 has been disclaimed.

[21] Appl. No.: 852,942

[22] Filed: Mar. 17, 1992

Related U.S. Application Data

[63] Continuation of Ser. No. 268,727, Nov. 7, 1988, Pat. No. 5,099,172.

[30] Foreign Application Priority Data

Nov. 9, 1987 [JP] Japan ..... 62-282843

[51] Int. Cl.[5] ..... H05B 33/14

[52] U.S. Cl. ..... 313/503; 313/502; 313/506

[58] Field of Search ..... 313/502, 503, 506, 509

[56] References Cited

U.S. PATENT DOCUMENTS

| | | | |
|---|---|---|---|
| 4,720,436 | 1/1988 | Ohseta et al. | 313/503 |
| 4,727,004 | 2/1988 | Tanaka et al. | 313/503 |
| 4,751,427 | 6/1988 | Barrow et al. | 313/503 |
| 5,099,172 | 3/1992 | Taguchi et al. | 313/503 |

FOREIGN PATENT DOCUMENTS 61-224292 4/1986 Japan .

OTHER PUBLICATIONS

Tanaka et al; MultiColor Electroluminescence in Alkaline Earth Sulfide Thin Film Devices; SID85 Digest; 1985; 218-221.

*Primary Examiner*—Donald J. Yusko
*Assistant Examiner*—Michael Horabik
*Attorney, Agent, or Firm*—Antonelli, Terry, Stout & Kraus

[57] ABSTRACT

A thin film electroluminescent (EL) device includes a pair of opposing electrodes formed on a substrate of a transparent electrical insulator, and an EL layer formed between the electrodes and covered at both surfaces with insulating layers respectively. Strontium sulfide is used as a host material of the EL layer, and its crystals tend strongly to have a (200) orientation, so that the resistance to free transit of electrons participating in emission of luminescence is substantially eliminated to ensure a higher brightness.

11 Claims, 6 Drawing Sheets

THIN FILM ELECTROLUMINESCENT DEVICE

This is a continuation of application Ser. No. 07/268,727, filed Nov. 7, 1988 now U.S. Pat. No. 5,099,172.

BACKGROUND OF THE INVENTION

1. Field of the Invention

The present invention relates to a thin film electroluminescent (called hereinafter EL) device which is excellent in quality of display and expected to provide a multicolor EL panel as well as a full-color EL panel which is excellent in the space factor when used as a planar EL display. More particularly, the present invention relates to a thin film EL device including a luminescent layer capable of emitting luminescence of high brightness.

2. Description of the Prior Art

A thin film EL device includes an insulating layer and a luminescent layer sandwiched between a transparent electrode and a back electrode. The principle of emission of luminescence from such an EL device is generally explained as follows. In response to the application of an alternating electric field having a strength of about $10^6$ V/cm across the transparent electrode and the back electrode, electrons are injected into the conduction band of the luminescent layer from the interface between the insulating layer and the luminescent layer. The injected electrons are then accelerated by the applied electric field to gain energy high enough to impinge and excite luminescent centers in the luminescent layer, and electroluminescence occurs when the excited luminescent centers return to the ground state.

A thin film EL device having a so-called double insulating layer structure is known, in which a luminescent layer containing zinc sulfide (ZnS) as a host material and having manganese (Mn) added to act as luminescent centers is sandwiched between a pair of insulating layers, and the insulating layers are further sandwiched between a pair of electrodes at least one of which is transparent. Such a thin film EL device is featured by a luminescence of high brightness and an extended useful service life and is now commercially available as an EL display having a light weight and a thin thickness. This thin film EL display emits a yellowish orange luminescence when manganese (Mn) is added to zinc sulfide (ZnS) as described above. When other elements such as thulium (Tm), samarium (Sm) and terbium (Tb) are added to the ZnS, the thin film EL display emits luminescences of different colors which are blue, red and green respectively. However, in the case of the ZnS, brightness of luminescences of these three primary colors is still insufficient.

Emission of multiple colors has been strongly demanded for an EL display, and researches and studies have been made so as to find a suitable host material preferably combined with elements such as those described above. Addition of a very small amount of cerium (Ce) to strontium sulfide (SrS) provides an EL layer emitting a bluish green luminescence, addition of a very small amount of europium (Eu) to calcium sulfide (CaS) provides an EL layer emitting a red luminescence, and addition of a very small amount of terbium (Tb) to zinc sulfide (ZnS) provides an EL layer emitting a green luminescence. Use of calcium sulfide (CaS) as a host material of an EL layer is disclosed in Japanese Patent Laid-Open Publication No. 224292/86. According to the disclosure of the publication, an EL device emitting luminescence of high brightness is obtained when the crystals of its thin film EL layer tend to have a (222) orientation.

Also, "Society for Information Display 85" Digest, No. 219, pp. 218–221 reports that, when strontium sulfide (SrS) is used as a host material of a luminescent layer, its crystals especially tend to have a (111) orientation strongly.

A prior art thin film of strontium sulfide (SrS) has been deposited by evaporation at a relatively low deposition rate of about 5 Å/s in order that the film can be successfully formed.

However, a thin film EL device using a prior art strontium sulfide film as described above has had a problem of emission of luminescence of low brightness. According to the results of investigation made by the inventors, this problem of emission of luminescence of low brightness is attributable to the fact that electrons tend to be scattered or dispersed and are not efficiently accelerated because of the presence of many crystal defects, lattice distortions and other defects occurred in the luminescent layer during the formation of the strontium sulfide film, and the brightness of luminescence is thereby lowered.

In order to increase the brightness of luminescence emitted from a thin film EL device, it becomes necessary to sufficiently clarify the physical and other factors including the crystallinity of its luminescent layer, the orientation of the crystals and the property of the interface between the luminescent layer and the adjoining insulating layer so as to make clear the principle of luminescence. However, most of these factors have not been clarified yet and are still unknown, and a thin film EL device capable of emitting luminescence of sufficiently high brightness has not been available up to now.

SUMMARY OF THE INVENTION

It is an object of the present invention to provide a thin film EL device capable of emitting luminescence of high brightness.

In accordance with one aspect of the present invention which attains the above object, there is provided a thin film EL device comprising a substrate of a transparent electrical insulator, a first electrode formed on the substrate, an EL layer formed on the first electrode through a transparent first insulating layer interposed therebetween, a transparent second insulating layer enclosing the exposed part of the EL layer, and a second electrode fomed on the second insulating layer, wherein at least one of the first and second electrodes is transparent, and the EL layer contains, as its host material, strontium sulfide strongly tending to have a (200) orientation.

Suppose now a three-dimensional coordinate system where one of the corners of a crystal is the origin, then, a plane which passes through a point distant by a distance of ½ from the origin along the x-axis and which is parallel to both the y-axis and the z-axis is called the (200) plane, while a plane passing through three points distant by a distance of 1 from the origin along each of the x-axis, y-axis and z-axis is called the (111) plane.

The crystals of strontium sulfide (SrS) have a crystal structure of the NaCl type. According to the thin film EL device of the present invention, when the tendency of crystal growth in the direction of the (200) plane is stronger than that in other directions, electrons emitted from the interface between the EL layer and the adjoining insulating layers are not appreciably scattered or obstructed, resulting in reduced obstacles against free transit of the electrons participating in emission of electroluminescence, and the thin film EL device emits luminescence of higher brightness.

In the thin film EL device of the present invention, the desired luminescence of high brightness is obtained when the ratio of the X-ray diffraction intensity of the (200) plane to that of the (111) plane is preferably selected to be three or more.

The above and other objects, novel features and advantages of the present invention will become more apparent from the following detailed description of preferred embodiments of the present invention when read in conjunction with the accompanying drawings.

DETAILED DESCRIPTION OF THE INVENTION

Figure 1:
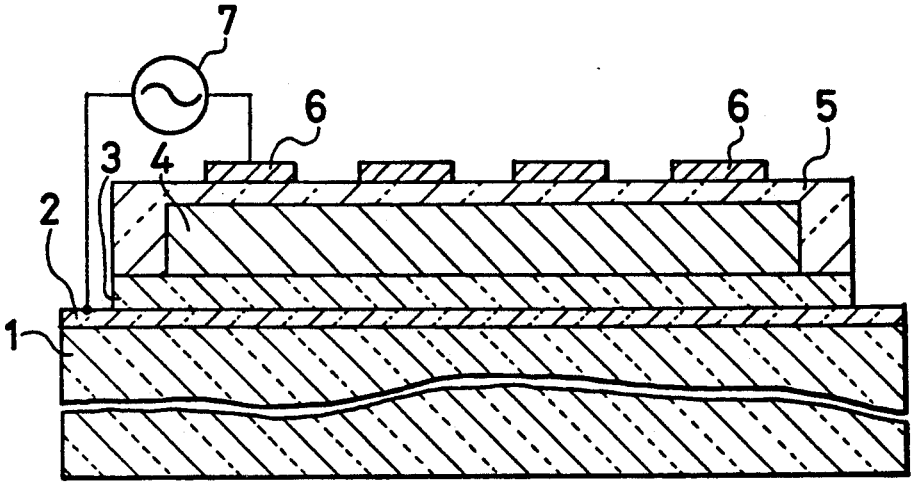
FIG. 1 is an enlarged schematic sectional view showing the structure of the thin film EL device according to a first embodiment of the present invention.

Referring to FIG. 1, a transparent electrode 2 of ITO (indium-tin-oxide, a mixture of $In_2O_3$ and $SnO_2$) is formed on a substrate 1 of glass, and a first insulating layer 3 consisting of a $SiO_2$ layer and a $Ta_2O_5$ layer and having a thickness of about 0.5 μm is formed on the transparent electrode 2 by the radio-frequency (called hereinafter as r.f.) sputtering method. Besides $SiO_2$ and $Ta_2O_5$ described above, the material of the first insulating layer 3 may be $Y_2O_3$, $Al_2O_3$, $TiO_2$, $SrTiO_3$ or $Si_3N_4$ or a composite material of any two of those materials. Cerium chloride ($CeCl_3$) acting as luminescent centers is added in an amount of 0.05 to 0.5 mol %, preferably, 0.1 mol % to powder of strontium sulfide (SrS), and the mixture is shaped into the form of pellets by a press to prepare a source which is to be evaporated. This source is evaporated by the electron-beam evaporation method to form an luminescent layer 4 on the first insulating layer 3. The film thickness of this luminescent layer 4 is set at about 0.5 to 1.5 μm, preferably, about 1 μm. Six kinds of such luminescent layers 4 are formed by changing the deposition rate while maintaining constantly the temperature of the substrate 1 at 500° C. The deposition rate can be varied by changing the electric power of the electron beam irradiation on the source.

A second insulating layer 5 of materials similar to those of the first insulating layer 3 is then formed on the luminescent layer 4 by the r.f. sputtering method, and a back electrode 6 of aluminum is formed on the second insulating layer 5 by the resistance heating evaporation method. The EL device thus obtained is driven by applying an a.c. voltage 7 across the transparent electrode 2 and the back electrode 6. The EL device emits a bluish green luminescence when SrS is used as a host material of its luminescent layer 4 and Ce is added to act as luminescent centers.

Figure 2:
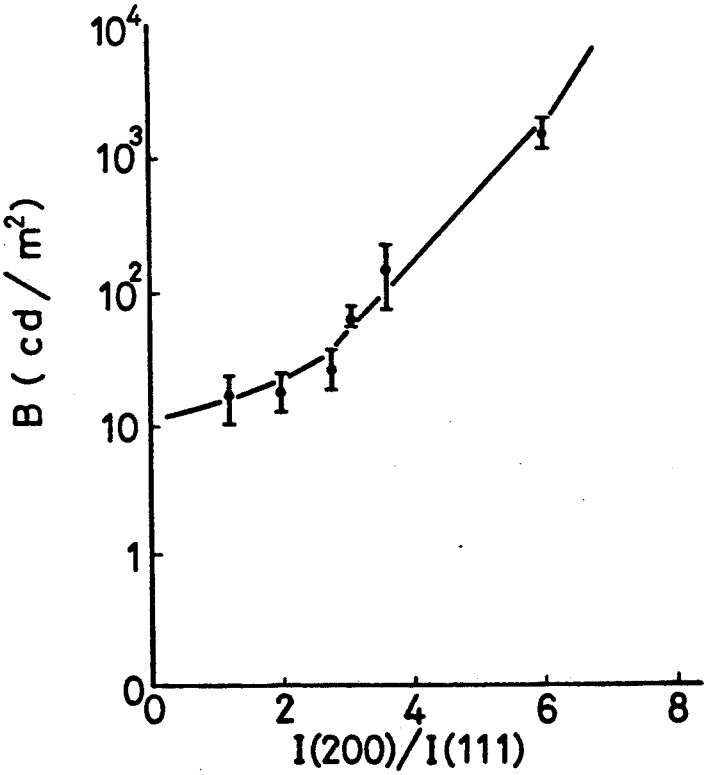
FIG. 2 is a graph showing the relation between the brightness of luminescence and the orientation of crystals of the EL layer in the thin film EL device shown in FIG. 1.
Figure 3:
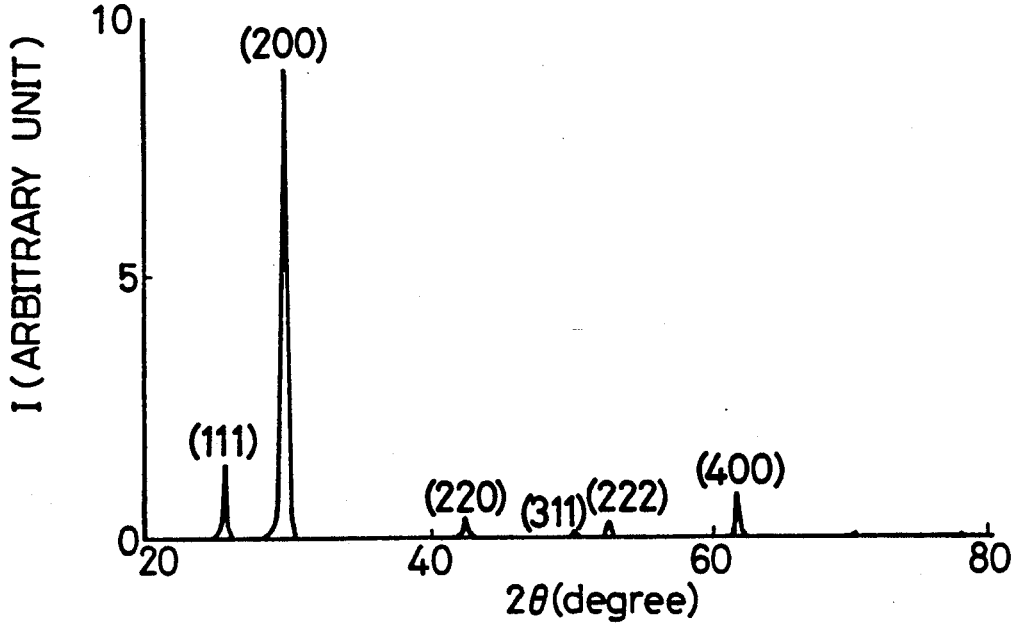
FIG. 3 is a graph showing an example of an X-ray diffraction pattern of the EL layer.

FIG. 2 is a graph showing the relation between the brightness B of luminescence and the orientation of crystals, as indicated by the intensity ratio due to (200) and (111) planes, of the luminescent layer ($SrS:CeCl_3$) 4 in the EL device shown in FIG. 1. FIG. 3 is a graph showing an example of a X-ray diffraction pattern of the luminescent layer ($SrS:CeCl_3$) 4 made by the method as described above. In FIG. 3, the horizontal axis represents the diffraction angle $2\theta$, and the vertical axis represents the X-ray diffraction intensity I. The X-ray diffraction pattern differs depending on the conditions used for forming the SrS luminescent layer. It will be seen in FIG. 3 that principal peaks of the X-ray diffraction intensity appear at diffraction angles corresponding to the (200), (111), (220), (400) and (222) planes. These planes are explained more precisely hereafter. Suppose now a three-dimensional coordinate system where one of the corners of a crystal is the origin, then, a plane passing through three points distant by a distance of 1 from the origin along each of the X-axis, Y-axis and Z-axis is called the (111) plane, while a plane which passes through a point distant by a distance of ½ from the origin along the X-axis and which is parallel to both the Y-axis and the Z-axis is called the (200) plane. In FIG. 3, the peaks of the X-ray diffraction intensity are relatively strong at the diffraction angles corresponding to the (200) and (111) planes. The intensities of these peaks are designated as I(200) and I(111) respectively, and the relative intensity ratio I(200)/I(111) is employed as an index for indicating the degree of orientation of crystals in the luminescent layer. It can be seen in FIG. 2 that the brightness of luminescence shows a significant increase with the increase in the value of the ratio I(200)/I(111). The increase in the brightness of luminescence is especially marked when the intensity ratio is three or more.

The intensities of the (200) and (111) planes are employed as parameters for the reason why numerical values observed at other planes fluctuate greatly due to low intensities and are not suitable to be selected as parameters representing the orientation of crystals.

Figure 4:
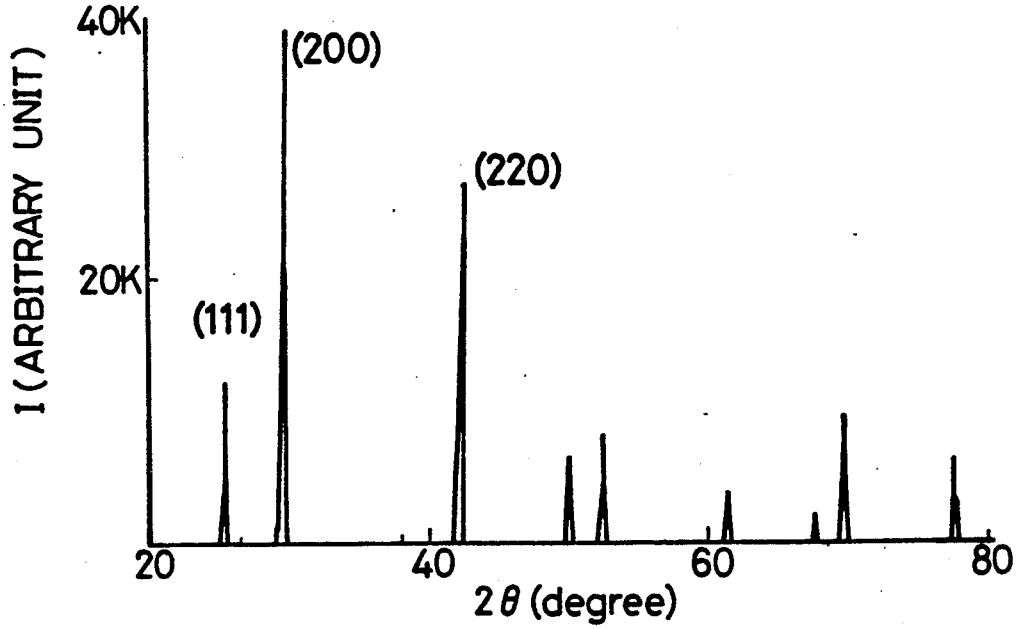
FIG. 4 shows the results of X-ray diffraction analysis of powder of strontium sulfide (SrS)

FIG. 4 shows the results of X-ray diffraction analysis for powder of SrS. As will be apparent from FIG. 4, the peak corresponding to the (200) plane is about three times as high as that corresponding to the (111) plane. Therefore, when the X-ray intensity of the (200) plane is three or more times as high as that of the (111) plane, this means that the crystals are strongly tending to have the (200) orientation.

Figure 5:
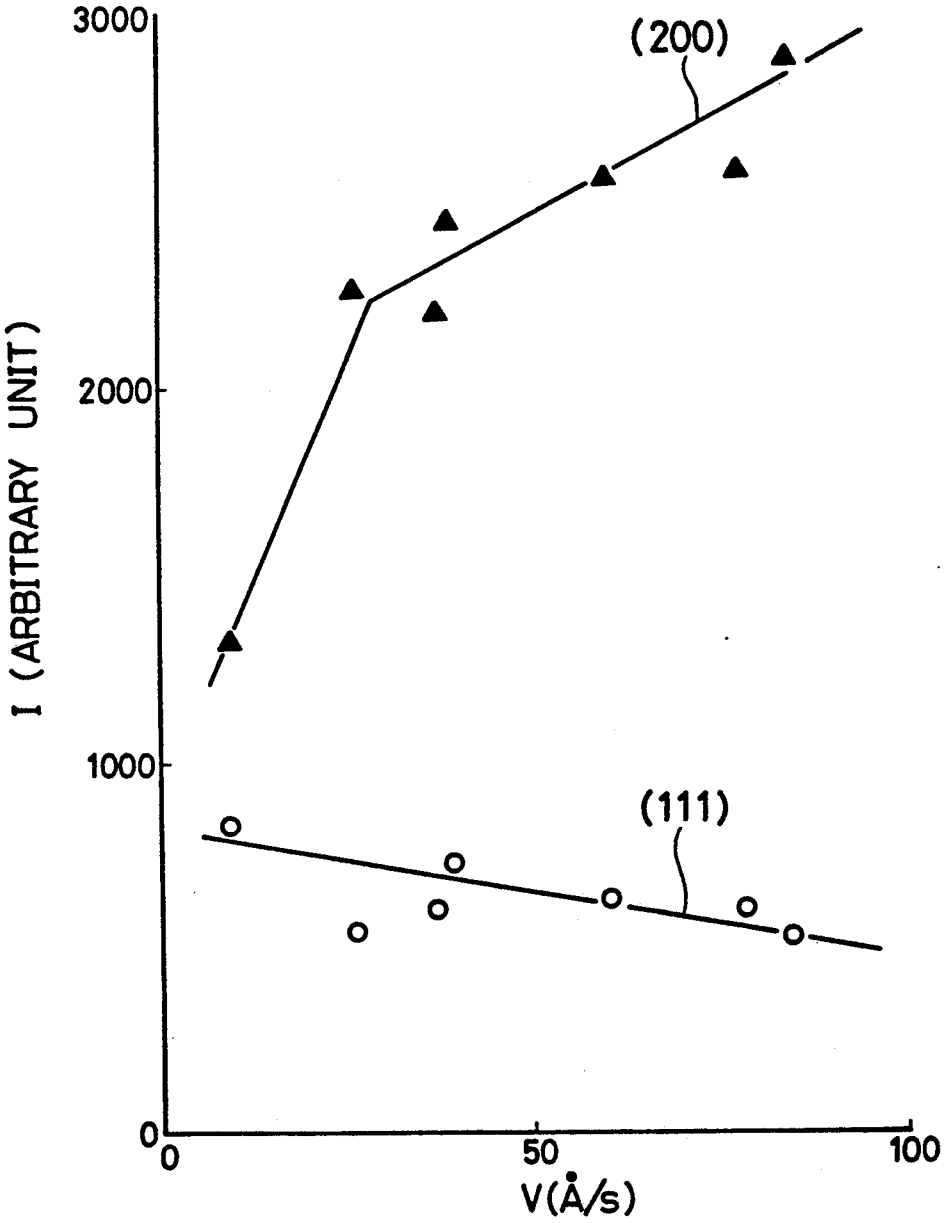
FIG. 5 is a graph showing the relation between the deposition rate and the X-ray diffraction intensity of crystals of strontium sulfide (SrS) film.

According to surveying the relation between the condition for the film growth and the orientation of SrS film, the crystals are tending to have the (200) orientation with increase of the deposition rate. FIG. 5 is a graph showing the relation between the deposition rate V and the X-ray diffraction intensity I. As will be apparent from FIG. 5, the X-ray intensity of the (200) plane shows a sharp decrease when the deposition rate is lower than 30 Å/s. The X-ray intensity shows a linear increase when the deposition rate lies in the range from 30 Å/s to 130 Å/s. On the other hand, the X-ray intensity of the (111) plane shows a progressive decrease with the increase in the deposition rate. Thus, with the increase in the deposition rate, the relative intensity ratio I(200)/I(111) between the intensities of the (200) and (111) planes can be increased. In order to increase the deposition rate, it is necessary to supply an electron beam of high energy for the source of the luminescent layer so as to heat the source up to a high temperature. Therefore, in order to raise the deposition rate, it is important to heat evaporated molecules up to a higher temperature. Thus, in the case of the luminescent layer whose host material is SrS, the crystals are to be strongly grown in the direction of the (200) plane so as to provide a structure which is substantially free from a trouble such as scattering of free electrons. In such a structure, the electrons can be efficiently accelerated to ensure-emission of luminescence of high brightness. According to a further investigation of the relation between the deposition rate and the orientation of SrS films, although the tendency of the films to have the (200) orientation becomes stronger with the increase of the deposition rate, the EL layer can not be successfully formed above 130 Å/s in the deposition rate because of an abnormal evaporation due to the decrease of a vacuum in the chamber. For the formation of the luminescent layer whose host material is SrS, any one of known methods including the r.f. sputtering method, the chemical vapor deposition (CVD) method, the molecular beam epitaxy (MBE) method and the atomic layer epitaxy (ALE) method may be used in lieu of the electron-beam evaporation method employed in the embodiment of the present invention described above. Also, an EL device capable of providing a multicolor display of high brightness is obtained when any one of elements such as Eu, Tb, Sm, Pr and Tm as well as any one of their salts such as sulfides, chlorides and fluorides is employed to act as luminescent centers. Further, although SrS is employed to form the luminescent layer of the EL device of the present invention, any one of various other sulfides such as CaS, BaS and MgS may be used in lieu of SrS.

A second embodiment of the present invention will now be described.

Figure 6:
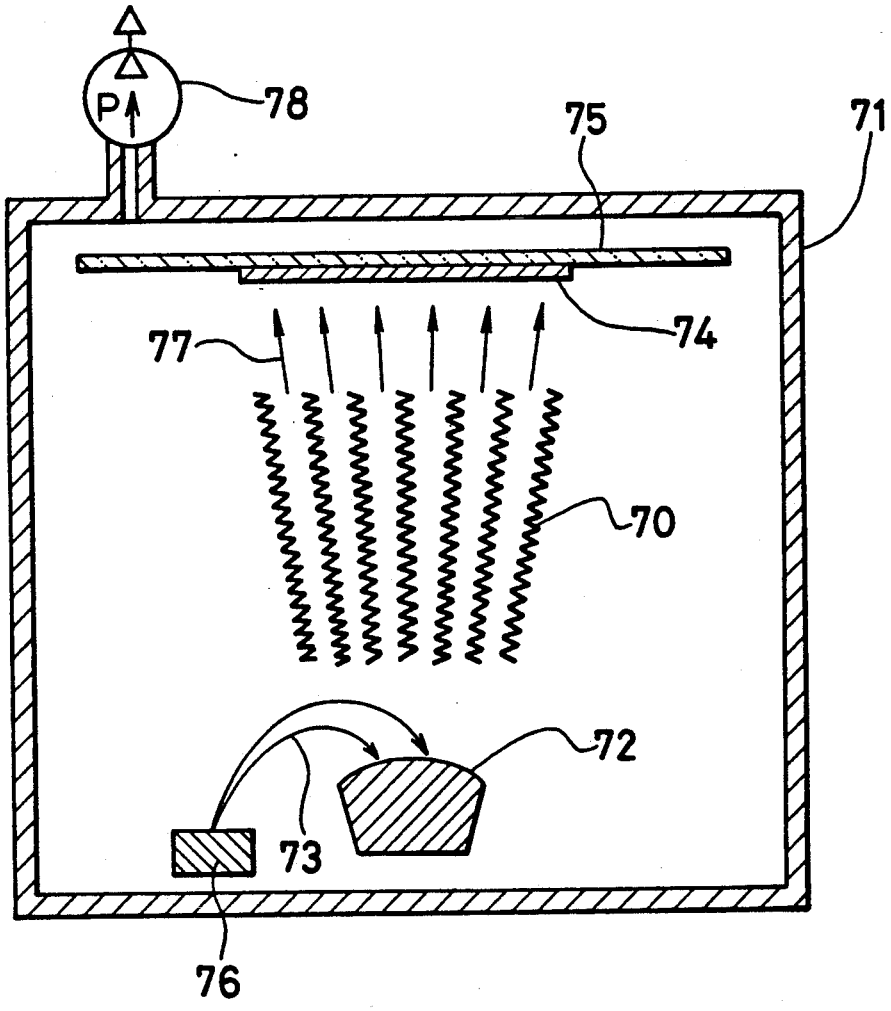
FIG. 6 is a schematic vertical sectional view showing the structure of an apparatus preferably used for manufacturing the thin film EL device according to a second embodiment of the present invention.

As in the case of the first embodiment described above, a transparent electrode of ITO is formed in a stripe pattern on a substrate of glass, and a first insulating layer consisting of an $SiO_2$ layer and a $Ta_2O_5$ layer is then formed on the transparent electrode. A luminescent layer is then formed on the first insulating layer. The material of the luminescent layer is $SrS:CeCl_3$ (0.1 mol %), and a heater 70 for heating evaporated molecules is disposed between the substrate and a source of the luminescent material as shown in FIG. 6. A plurality of samples of the EL device are manufactured while changing the deposition rate of the luminescent layer.

FIG. 6 shows schematically the structure of an apparatus used for manufacturing the thin film EL device according to the present invention. Referring to FIG. 6, an electron beam 73 emitted from an electron beam source 76 is directed toward a source 72 of SrS, and evaporated molecules of SrS are heated by the heater 70 to deposit a film 74 of SrS on a glass substrate 75. The reference numerals 71, 77 and 78 designate an evacuated chamber, directions of evaporated molecules and a vacuum pump respectively. In each of the samples of the second embodiment, the film thickness of the luminescent layer is set at about 1 μm. By a method similar to that used to provide the first insulating layer, a second insulating layer is formed on the luminescent layer, and a back electrode of aluminum is then formed on the second insulating layer.

Figure 7:
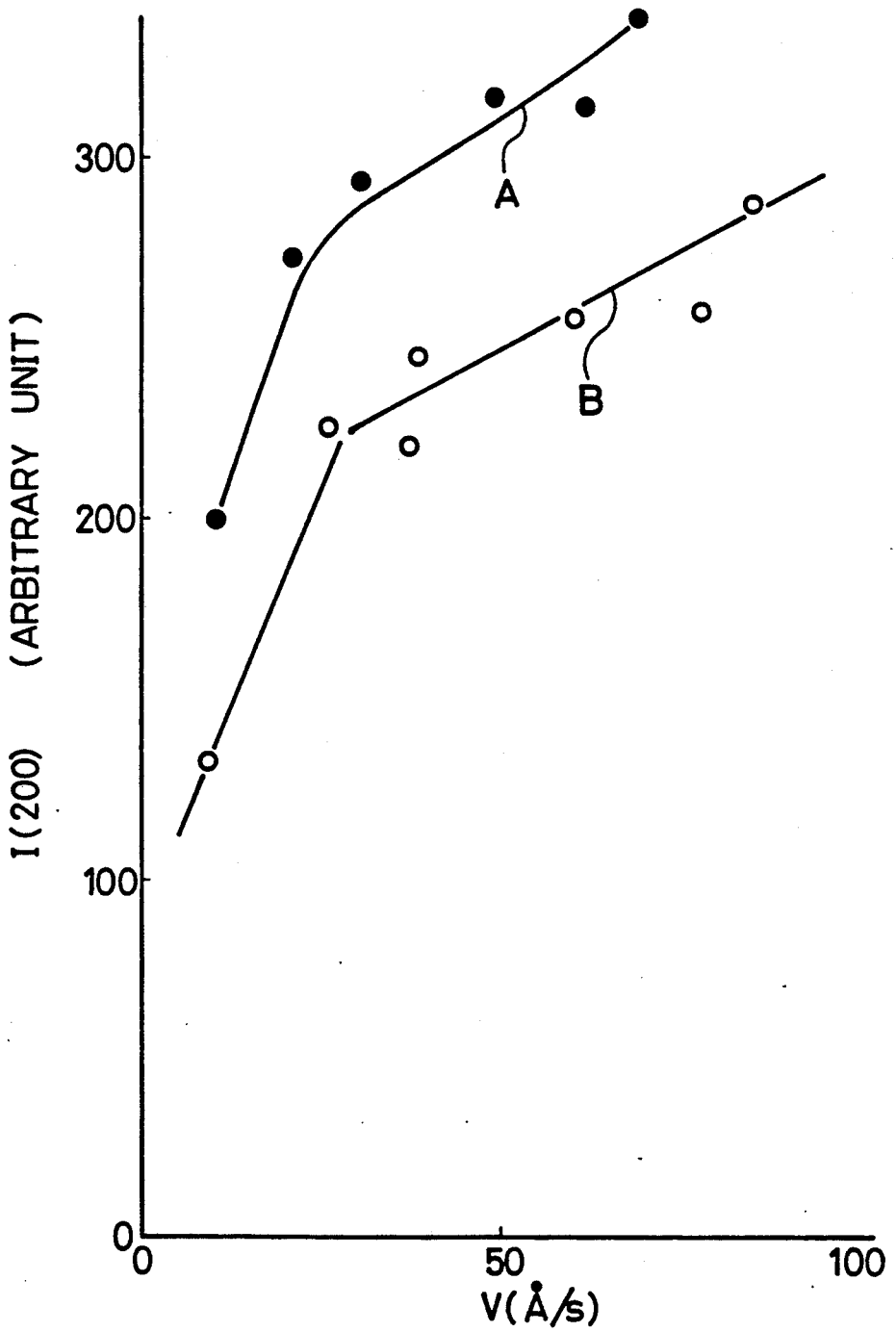
FIG. 7 is a graph showing the relation between the deposition rate and the X-ray diffraction intensity of the (200) plane in the thin film EL devices manufactured by the apparatus shown in FIG. 6.

FIG. 7 is a graph showing the relation between the deposition rate V of the luminescent layer and the X-ray diffraction intensity I of the (200) plane of the thin film of the second embodiment. The characteristic curve A represents the above relation in the case of the sample of the EL device in which the SrS film is deposited under heating by the heater disposed between the glass substrate and the SrS source to heat the evaporated molecules of SrS, while the characteristic curve B represents the above relation in the case of the sample of the EL device in which the SrS film is deposited without the use of the heater. By increasig the deposition rate of the luminescent layer, the crystals tend strongly to have the (200) orientation. Thus, when the sample of the EL device manufactured by using the heater disposed between the glass substrate and the SrS source to heat the evaporated molecules is compared with the sample of the EL device manufactured without the use of the heater, it is apparent that the crystals of the luminescent layer in the former sample tend very strongly to have the (200) orientation. The results of measurement of the brightness prove that the brightness of luminescence of the device represented by the curve A is remarkably higher than that of the device represented by the curve B.

Figure 8:
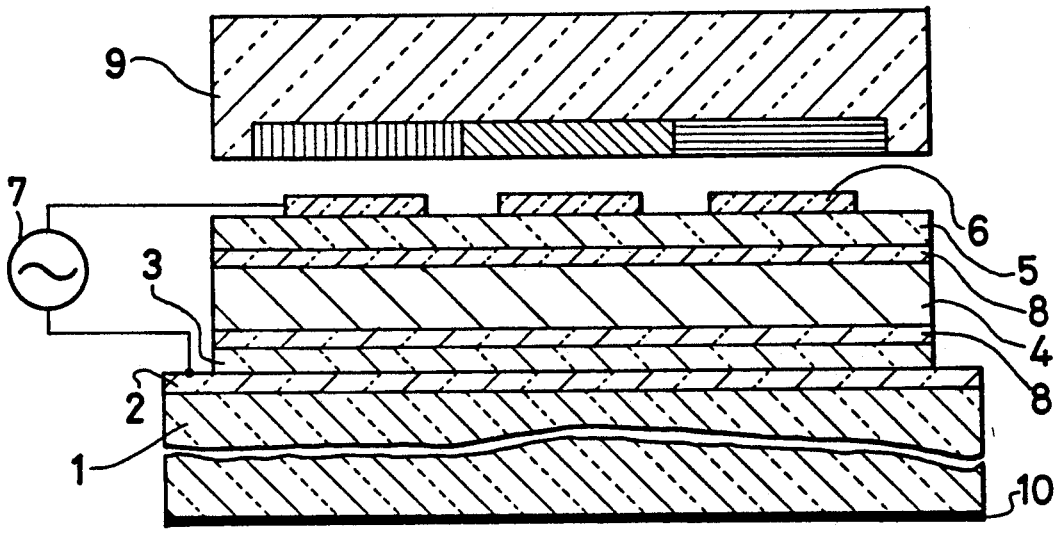
FIG. 8 is an enlarged schematic sectional view showing the structure of the thin film EL device according to third and fourth embodiments of the present invention.

The EL device according to a third embodiment of the present invention will now be described. The EL device has the same structure as that of the first embodiment as shown in FIG. 8, except that the first and the second insulating layers 3 and 5 are single films of $Ta_2O_5$ each having a thickness of 0.5 μm formed by the r.f. sputtering method and that a film 8 of ZnS having a thickness of 0.15 μm formed by the electron-beam evaporation method is interposed between the luminescent layer 4 and each of the insulating layers. Such ZnS films are interposed so as to improve the degree of close adhesion of the luminescent layer to the insulating layers. The luminescent layer in the third embodiment is formed by a process as described below.

After adding $CeCl_3$ powder and $PrCl_3$ powder respectively in an amount of 0.1 mol % to powder of SrS and thoroughly agitating the mixture, the mixture is molded under compression to obtain pellets used as an evaporation source. Then, these pellets are heat-treated at 900° C. for one hour in an atmosphere of $H_2S$ gas to desiccate and reduce the evaporation sources. The heat-treated pellets are used to manufacture two EL devices including luminescent layers deposited at the deposition rate of 15 Å/s and 60 Å/s respectively. During the step of depositing these luminescent layers in an evacuated chamber, sulfur (S) under a partial pressure of 1 to $2\times10^{-2}$ Pa is introduced, and the temperature of the substrates is maintained at 450° C. The reason why S is introduced into the evaporating atmosphere is to compensate for deficieney of S within the luminescent layers.

Table 1 shows the luminescence characteristics of the two EL devices manufactured by the process described above.

TABLE 1

| Luminescence characteristics of EL devices | | | |
|---|---|---|---|
| No. | Deposition rate (Å/s) | I(200)/I(111) | Brightness (cd/m$^2$) at 250 V |
| 1 | 15 | 1.8 | 80 |
| 2 | 60 | 19 | 2,500 |

Figure 9:
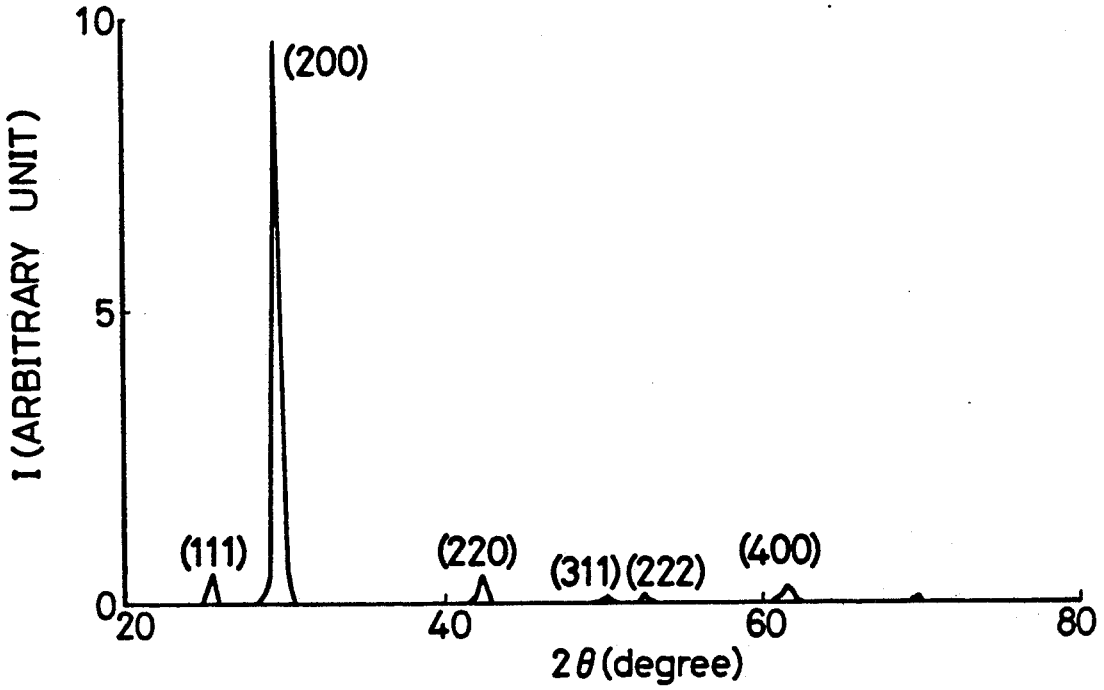
FIG. 9 is a graph showing an X-ray diffraction pattern of the EL layer according to the third embodiment.

The results of X-ray diffraction analysis prove that the relative intensity ratio I(200)/I(111) of the EL device No. 1 having its luminescent layer formed at the deposition rate of 15 Å/s is as low as 1.8, and the crystals of the lulminescent layer do not tend to the (200) orientation. In this case, the brightness of the EL device No. 1 is only 80 cd/m$^2$ at 250 V. In contrast, in the case of the EL device No. 2 whose luminescent layer is formed at the deposition rate of 60 Å/s, the relative intensity ratio I(200)/I(111) is as high as 19. FIG. 9 shows the X-ray diffraction pattern of the EL device No. 2. It will be apparent from FIG. 9 that the X-ray intensity of the (200) plane is remarkably higher than that of the (111) plane. The inventors consider that such a very large value of I(200)/I(111) is attributable to the evaporation of the source in the presence of the partial pressure of S. It will be seen in Table 1 that the brightness of the EL device No. 2 whose luminescent layer is formed at the deposition rate of 60 Å/s is 2,500 cd/m$^2$ which is about thirty times as high as that of the EL device No. 1 whose luminescent layer is formed at the deposition rate of 15 Å/s.

The luminescent layer formed by adding both of Pr and Ce as a guest to the host material of SrS (referred to hereinafter as an SrS:Pr, Ce luminescent layer) emits a white electroluminescence. It is confirmed that the EL device No. 2 can emit electroluminescences of three primary colors (red, green and blue) when three primary-color filters are respectively combined with the EL device. The above fact indicates that a multicolor EL device can be realized by combining such a filter assembly with the SrS:Pr, Ce luminescent layer.

In a fourth embodiment of the present invention as shown in FIG. 8, a film 2 of ITO is formed on a glass substrate 1 in a stripe pattern consisting of three stripes per mm, and a film 3 of $Ta_2O_5$ having a thickness of 0.4 μm is formed on the patterned ITO film 2 of the glass substrate by the r.f. sputtering method. Then, a layer 8 of ZnS having a thickness of 0.15 μm is formed on the $Ta_2O_5$ film by the electron beam evaporation method. Then, an SrS:Pr, Ce luminescent layer 4 having a thickness of 1.5 μm is formed on the ZnS layer 8 by the electron-beam evaporation method. The deposition rate of the luminescent layer 4 is 60 Å/s, and the evaporation is carried out in an evacuated chamber containing sulfur under a partial pressure of $1.5\times10^{-2}$ Pa. During the above step, the temperature of the glass substrate 1 is maintained at 500° C. Subsequently, the temperature of the glass substrate placed in the evaccuated chamber is decreased to and maintained at 200° C., and a layer 8 of ZnS having a thickness of 0.15 μm is formed on the SrS:Pr, Ce luminescent layer 4. Then, a second insulating layer 5 comprising a film of $Ta_2O_5$ having a thickness of 0.3 μm and a film of $SiO_2$ having a thickness of 0.1 μm is successively formed in the above order on the ZnS layer by the r.f. sputtering method. Then, a film 6 of ITO having a thickness of 0.25 μm is formed on the $SiO_2$ film by the r.f. sputtering method. Subsequently, the methods of photo-lithography and ion milling are used to remove portion of the ITO film 6 so as to leave the ITO film in a stripe pattern consisting of three stripes per mm. In this case, the patterning is such that the direction of the ITO stripe pattern is orthogonal with respect to that provided on the glass substrate. As both the electrodes of the EL device are transparent, luminescence can be derived through both the electrodes, and a black sheet 10 is located on the back of the glass substrate so as to improve the contrast. A filter pattern 9 of three primary colors (that is, a stripe filter pattern conforming to the stripe electrode pattern) is provided on the finally-formed ITO pattern to make substantially intimate contact therewith. FIG. 8 is a partly sectional, schematic view of the completed EL device. It is confirmed that, by suitably turning on-off the electrodes in the stripe pattern corresponding to the filter pattern of red, green and blue, the EL device can display characters in eight colors, that is, red, green, blue, white, black and yellow, bluish green and purple which are intermediate colors.

It will be understood from the foregoing detailed description that the rate of crystal growth in the direction of the (200) plane in the EL layer of strontium sulfide in the thin film EL device of the present invention is higher than that in the directions of other planes. Therefore, the resistance to free transit of electrons participating in emission of electroluminescence is substantially eliminated, so that the thin film EL device can emit electroluminescence of higher brightness.

What is claimed is:

1. A thin film EL device comprising a substrate of a transparent electrical insulator, a first electrode formed on said substrate, an EL layer formed on said first electrode through a transparent first insulating layer interposed therebetween, a transparent second insulating layer enclosing the exposed part of said EL layer, and a second electrode formed on said second insulating layer, wherein at least one of said first and second electrodes is transparent, said EL layer contains, as its host material, strontium sulfide whose crystals strongly tend to have a (200) orientation, and the ratio of the X-ray diffraction intensity I(200)/I(111) is more than three.

2. An EL device according to claim 1, wherein said EL layer has a film thickness of 0.5 to 1.5 μm.

3. An EL device according to claim 1, wherein one of said first and second electrodes is transparent and is formed of ITO (indium tin oxide).

4. An EL device according to claim 3, wherein another of said first and second electrodes is formed of aluminum.

5. An EL device according to claim 1, wherein each of said first and second insulating layers is formed of $SiO_2$ and $Ta_2O_5$.

6. An EL device according to claim 1, wherein each of said first and second insulating layers is formed of a material selected from the group consisting of $SiO_2$, $Ta_2O_5$, $Y_2O_3$, $Al_2O_3$, $TiO_2$, $SrTiO_3$, $Si_3N_4$ and composite material of any two of those materials.

7. An EL device according to claim 1, wherein the host material of said EL layer contains luminescent centers in an amount of 0.05 to 0.5 mol %.

8. An EL device according to claim 7, wherein said electroluminescent centers are at least one of materials selected from the group consisting of Ce, Eu, Tb, Sm, Pr, Tm, and their sulfides, chlorides and fluorides.

9. An EL device according to claim 1, wherein each of said first and second electrodes is transparent and is formed of ITO (indium tin oxide).

10. An EL device according to claim 1, wherein said first electrode is formed of ITO (indium tin oxide) and said second electrode is formed of aluminum.

11. A thin film electroluminescent device having high brightness of luminescence comprising;

a substrate made of a transparent electrical insulator;

a first electrode formed on said substrate;

a transparent first insulating layer formed on said first electrode;

an electroluminescent layer formed over said transparent first insulating layer, said electroluminescent layer comprising, as its host material, a layer of strontium sulfide having a (200) orientation stronger than the (200) orientation of strontium sulfide in a powder form, wherein a ratio of an x-ray diffraction intensity I(200)I(111) of said layer of strontium sulfide is more than three;

a transparent second insulating layer formed over and enclosing said electroluminescent layer; and a second electrode formed on said transparent second insulating layer, wherein at least one of said first and second electrodes is transparent.

* * * * *